US006676066B2

(12) United States Patent
Keel

(10) Patent No.: US 6,676,066 B2
(45) Date of Patent: Jan. 13, 2004

(54) SPIRAL WINDER WRINKLE REMOVER

(75) Inventor: Donald Wayne Keel, Flower Mound, TX (US)

(73) Assignee: Recot, Inc., Pleasanton, CA (US)

( * ) Notice: Subject to any disclaimer, the term of this patent is extended or adjusted under 35 U.S.C. 154(b) by 27 days.

(21) Appl. No.: 10/058,639

(22) Filed: Jan. 29, 2002

(65) Prior Publication Data

US 2003/0141405 A1 Jul. 31, 2003

(51) Int. Cl.[7] ..... B65H 23/04

(52) U.S. Cl. ..... 242/548; 242/548.1; 242/615.1; 242/615.2; 226/21

(58) Field of Search ..... 242/548, 548.1, 242/419.8, 471, 615.1, 615.2; 226/21, 23

(56) References Cited

U.S. PATENT DOCUMENTS

| | | | | | |
|---|---|---|---|---|---|
| 163,207 | A | * | 5/1875 | Kellberg | 242/548.1 |
| 553,935 | A | * | 2/1896 | Purdy | 242/471 |
| 1,240,631 | A | * | 9/1917 | Trier | 242/419.8 |
| 3,095,131 | A | * | 6/1963 | Robertson et al. | 226/23 |
| 3,716,435 | A | | 2/1973 | Jensen et al. | |
| 3,776,442 | A | * | 12/1973 | Ridley | 242/615.1 |
| 4,420,121 | A | * | 12/1983 | Shawcross et al. | 242/615.1 |
| 4,546,656 | A | | 10/1985 | Grundy et al. | |
| 4,548,085 | A | | 10/1985 | Grundy | |
| 4,700,905 | A | * | 10/1987 | Oppelt et al. | 242/548.1 |
| 5,669,564 | A | | 9/1997 | Keller et al. | |
| 5,779,758 | A | | 7/1998 | Mann et al. | |
| 5,906,305 | A | * | 5/1999 | Knorr | 226/21 |
| 6,024,131 | A | | 2/2000 | Lester et al. | |
| 6,105,899 | A | * | 8/2000 | Harris | 226/23 |
| 6,354,531 | B1 | * | 3/2002 | Aalto et al. | 242/548.1 |

* cited by examiner

*Primary Examiner*—John M. Jillions
(74) *Attorney, Agent, or Firm*—Colin P. Cahoon; Carstens, Yee & Cahoon, L.L.P.

(57) ABSTRACT

A spiral winder wrinkle remover capable of wrapping a material of varying thickness into a structurally stable, smooth coil. As a material is supplied to the spiral winder, the collecting device, such as a spool, rotates and oscillates linearly along the axis of rotation to distribute the material along the length of the collecting device and form a structurally stable coil of material. As the material is directed to the collecting device it is threaded through a tilting guide. The guide tilts with the linear oscillations of the collecting device and maintains a uniform tension across the width of the material. The oscillations and tilting guide ensure that a material, particularly if the material's thickness varies along its width, is wrapped into a structurally stable coil where the layers of the coil are wrapped smoothly, without folds or wrinkles.

14 Claims, 5 Drawing Sheets

SPIRAL WINDER WRINKLE REMOVER

BACKGROUND OF THE INVENTION

1. Technical Field

The present invention relates generally to wrapping material onto a device. More particularly, the present invention relates to a method and apparatus for coiling a film of material onto a device such as a pin or spool, where the material is coiled without wrinkling or twisting, despite variations in the thickness of the film.

2. Description of Related Art

Where applicable, using a device such as a spool, reel, or pin, to collect, store, and dispense materials is convenient and common with such everyday end products as carpet, paper, aluminum foil, and garbage bags. In addition, it is common and convenient to use such devices to collect, store, and dispense materials for use in further manufacturing steps.

Depending on the type of material being processed and intended future use, different mechanisms may be employed to effectively use a spool to collect a material. Variables such as speed, tension, and the amount of material stored on a spool may need to be adjusted for different applications.

In the snack food industry, for example, films of packaging material are commonly coiled onto spools and later dispensed in further manufacturing steps. The process of winding such packaging material onto a spool, reel, or pin is best described by referring to FIGS. 1*a* and 1*b*. FIG. 1*a* shows a typical spiral winder of the prior art. FIG. 1*b* shows the same prior art spiral winder with a film of material 10 being supplied to the winder and collected onto a spool 20. For purposes of this application, a spool may be any kind of rotatable collecting device, such as a reel, pin, bobbin, or spool. Also shown in FIG. 1*b* are an upper guide 80 and lower guide 90 that provide tension and direction to the material 10 as it is gathered onto the spool 20. The upper guide 80 and lower guide 90 maximize the of material stored on any one spool 20, and ensure the material 10 is coiled tightly and evenly on the spool 20, so the coiled configuration itself is structurally secure and stable. In addition, the upper guide 80 and lower guide 90 ensure that the material 10 is coiled smoothly in order to avoid folds or wrinkles. The configuration in FIG. 1*b* is ideally employed where the material being coiled 10 is of uniform thickness.

Referring to FIG. 1*c*, in certain applications the material 10 being collected onto a spool 20 may vary in thickness across its width 170. An example of this known to Applicants is where the material 10 being collected on a spool 20 is a continuous sheet of material 10, having a zipper seal 30 attached along the length of the sheet 10, that will later be used to form re-closable pouches. In such instances, use of a spiral winder of the prior art, such as the one in FIG. 1*e*, leads to problems.

Referring again to FIG. 1*c*, consider the situation presented when processing material that will later be used to form re-closable pouches. The area of the re-closable seal 30 is visible along one edge of the sheet of material 10. The difference between the thickness of the sheet 10 in the area of the re-closable seal 30, and the thickness of the remainder of the sheet, may be significant when attempting to effectively coil the material 10 onto the spool 20.

One of the problems caused by coiling a material 10 onto a spool 20 using a spiral winder of the prior art, where there is some variation in thickness along the width of the material 170, is that less material may be stored on a single spool. Reducing the amount of material stored per spool in a high volume production environment greatly increases production costs.

Telescoping is another problem caused by such a variation in thickness along the width of a material collected on a spool. A film thickness variation causes one side of the to be coiled much thicker and tighter than the other. The differences in thickness and tautness result in the spool of material having an unstable character. Once coiling of a material onto a spool or pin is complete, it may be necessary to remove the coiled material from the spiral winder. Upon removal of the spool of material from the winder, the coiled material may telescope to the loose side of the coil such that the material is no longer contained in a coiled configuration at all, but takes on a conic or telescopic shape. Loss of the coiled configuration renders that configuration unrecoverable without tedious and time-consuming unraveling, causes the spool of material to be unsuitable for use in further processes, and often results in loss of product.

Referring again to FIG. 1*c*, one prior art proposed solution to this problem known to applicants calls for the spool 20, as it collects material, to move laterally, back and forth, along its axis of rotation 140. This motion resembles that of a fishing reel as the film of material 10 wraps onto the spool 20, while the spool 20 oscillates along its axis 140 to distribute the film. Although employment of this technique allows more material to be collected on each spool and prevents the coiled configuration from telescoping, other problems are presented. The back and forth lateral motion of the spool 20 along its axis 140, together with the inflexible restraint provided by the upper guide 80 and lower guide 90, causes the tension in the material 10 to vary along the material's width 170 as it is wrapped. This variation in tension along the width of the material 170 as it is wrapped results in slack along one edge of the material and corresponding variations in tightness between layers of the coiled material on the oscillating spool. In any given region where such a variation in tightness between layers is present, the material in that region in a preceding layer on the spool may be loose enough that a following, tighter layer causes the material of the preceding layer to wrinkle in the region. Such wrinkling and folding may become permanent and large portions of material cosmetically unacceptable for ultimate sale. Wrinkling may also render materials unable to be used in further processes that require the materials to be smooth. In addition, wrinkling may ultimately cause failure in the structure of the material, resulting in cracks or holes in the material.

Consequently, what is needed is a spiral winder that is capable of processing material of uniform or varying thickness. Despite any thickness variations, the spiral winder must be capable of wrapping materials onto a spool without folds or wrinkles in order to avoid defects in further processes and end-user products. Additionally, as a spiral winder wraps a material onto a spool, the winder must maintain a uniform tension on the material and distribute the material evenly on the spool in order to maximize spool capacity and form a roll stable enough to be transported, stored, or used to dispense the material to product end-users or further processes.

SUMMARY OF THE INVENTION

The proposed invention comprises a spiral winder that winds materials onto a spool and compensates for thickness variations along the width of a film of material. The compensations are accomplished by horizontal oscillations of the spool and by employing a pivoting guide roller to maintain uniform tension on the material as it is coiled onto the spool.

By accounting for variations in film thickness, the present invention maximizes spool capacity, prevents folds and wrinkles that result in loss of product, and ensures the stability of the resulting roll of material necessary for further processing.

DESCRIPTION OF THE DRAWINGS

The novel features believed characteristic of the invention are set forth in the appended claims. The invention itself, however, as well as the preferred mode of use, further objectives and advantages thereof, will be best understood by reference to the following detailed description of illustrative embodiments when read in conjunction with the accompanying drawings, wherein:

DESCRIPTION

Figure 1A:
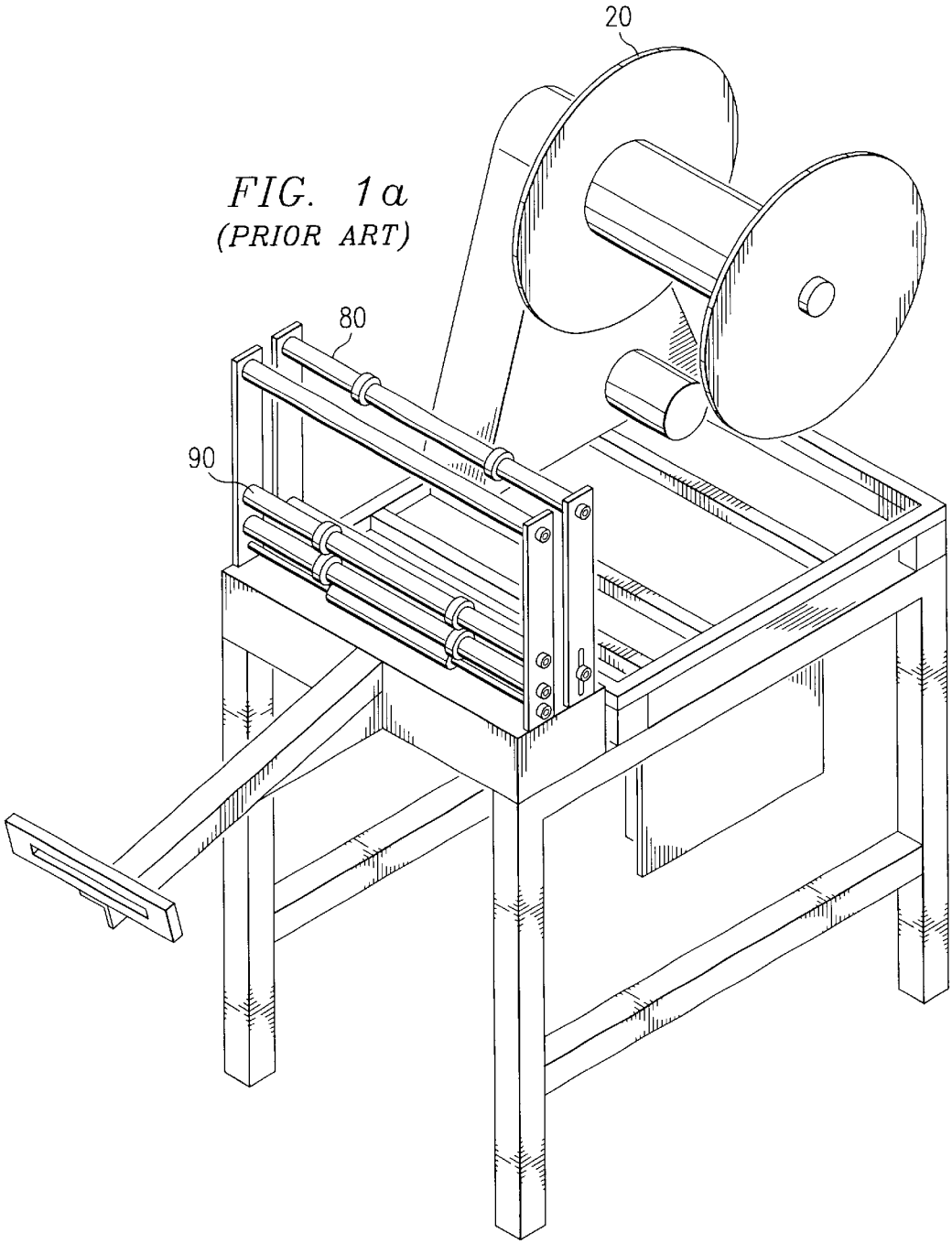
FIG. 1a (PRIOR ART)
FIG. 1*a* is an illustration of a spiral winder of the prior art.
Figure 1B:
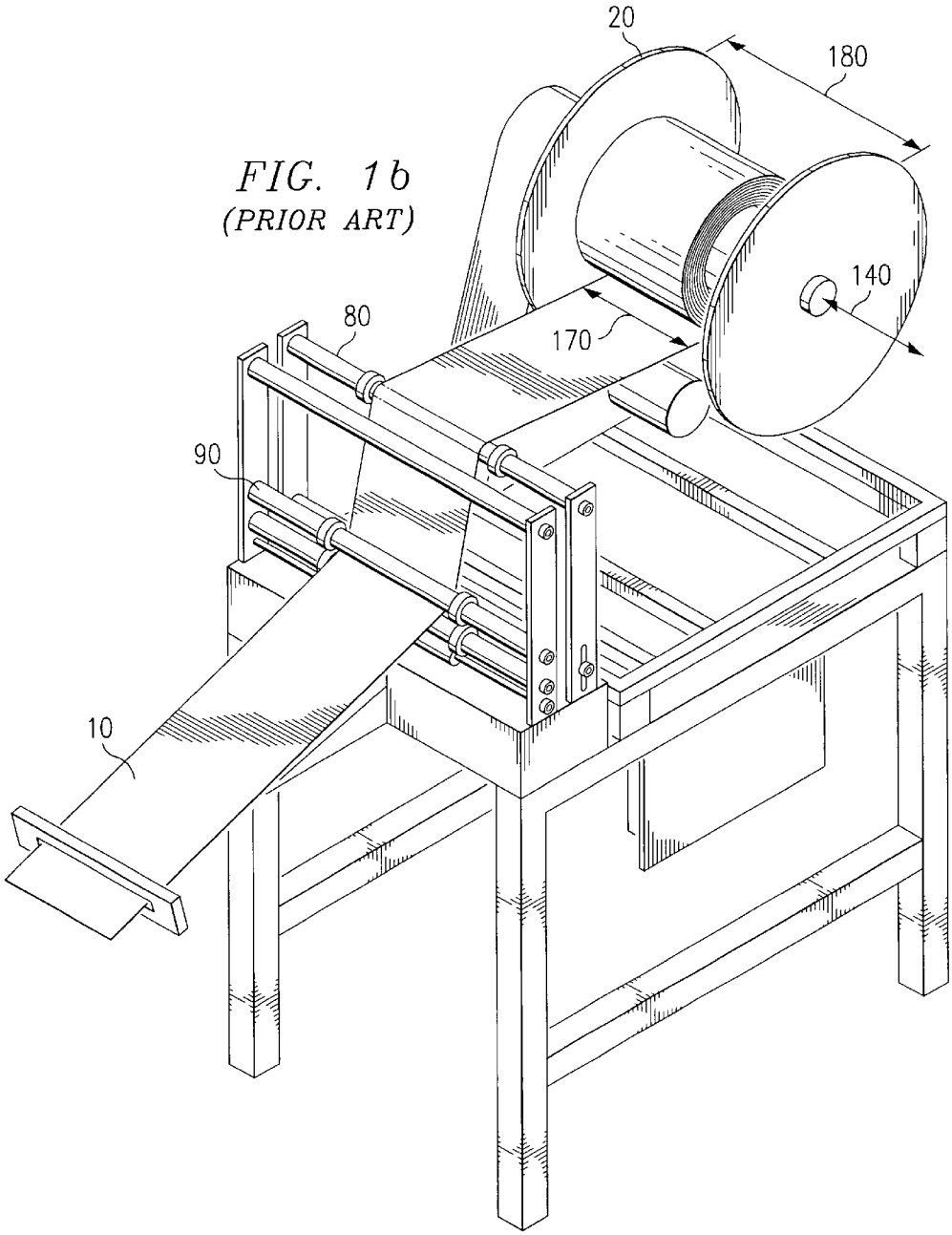
FIG. 1b (PRIOR ART)
FIG. 1*b* is the spiral winder of FIG. 1*a* that is supplied with a film of material.
Figure 1C:
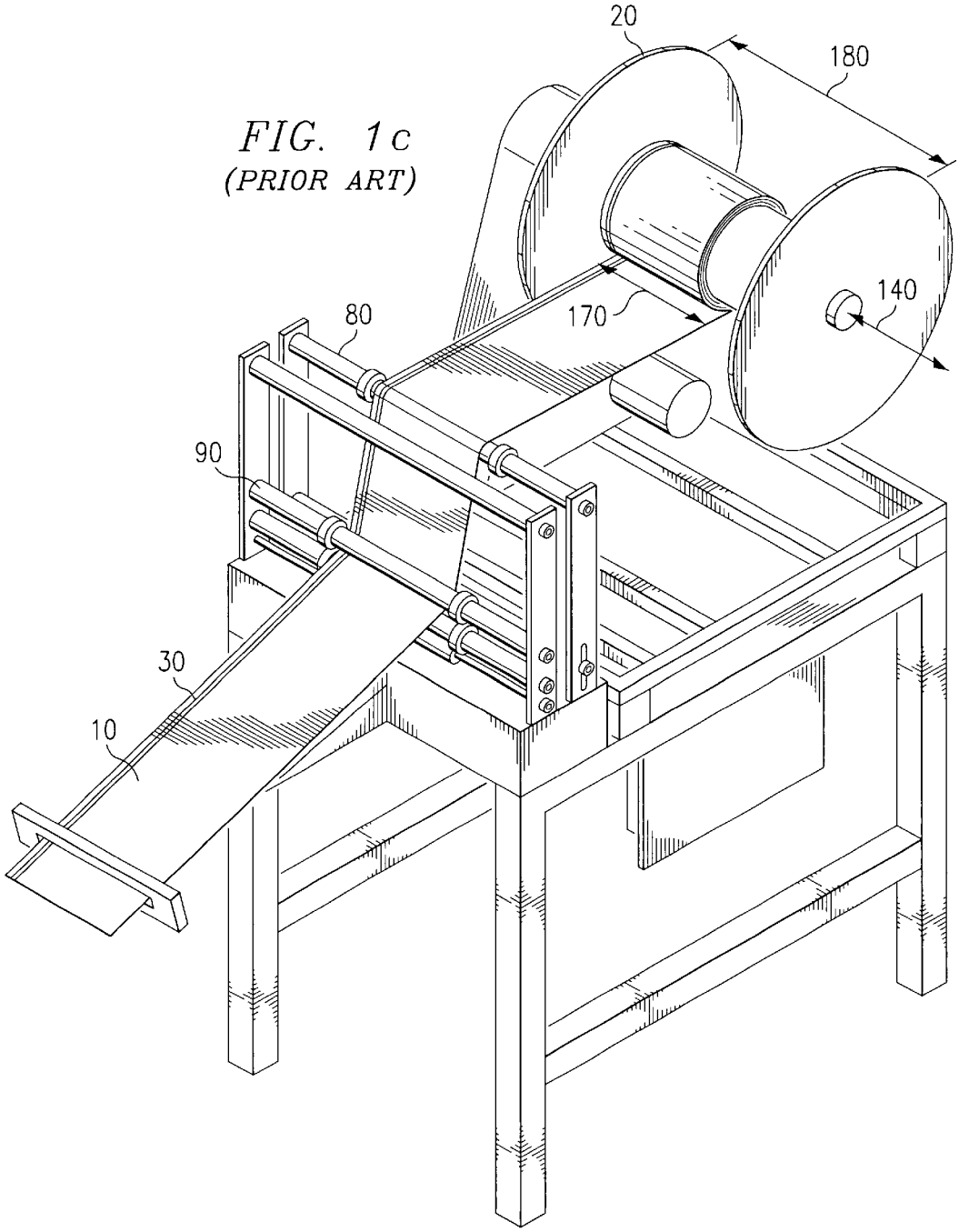
FIG. 1c (PRIOR ART)
FIG. 1*c* is the spiral winder of FIG. 1*b*, including a zipper seal attached along the length of the sheet.
Figure 2A:
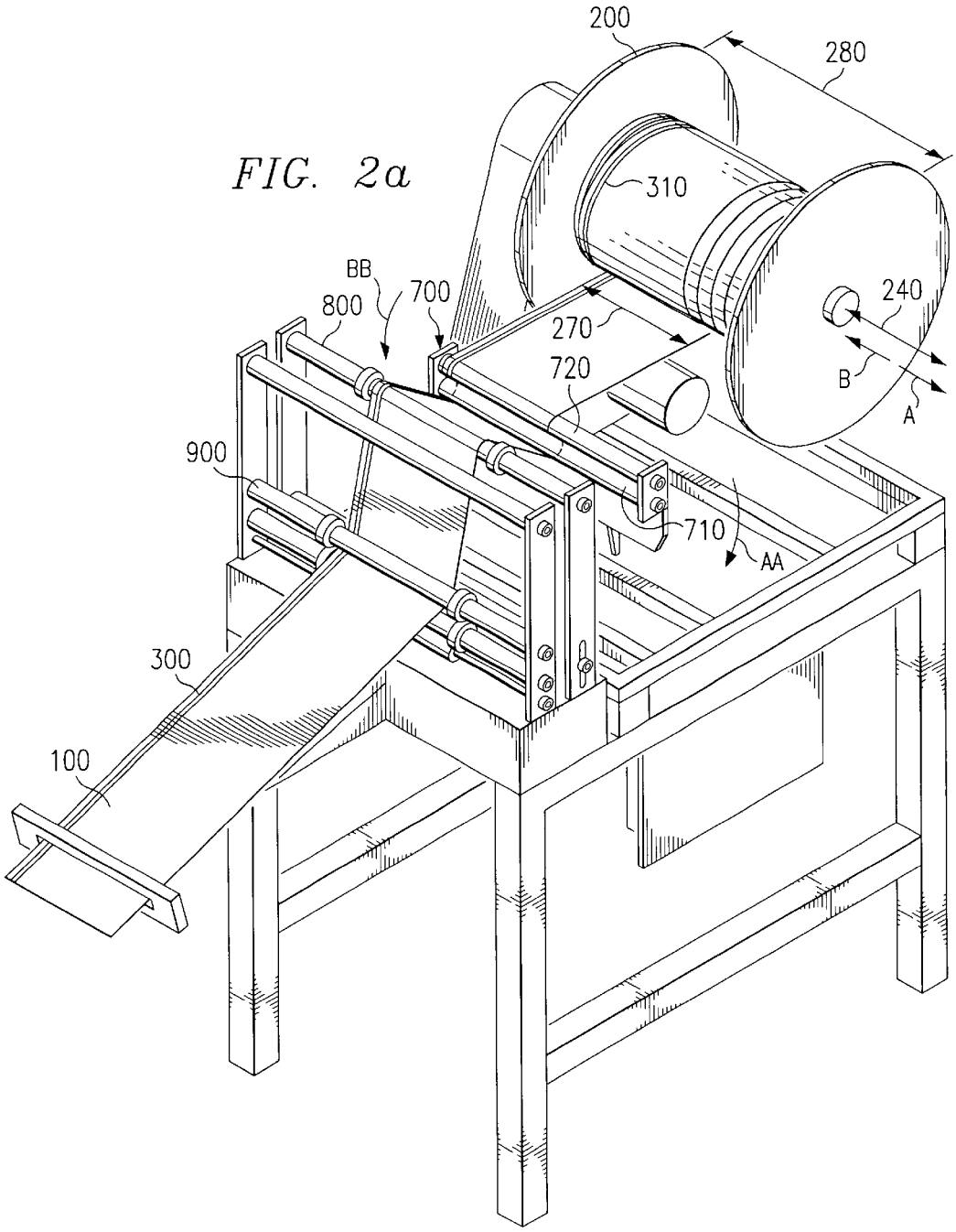
FIG. 2*a* is an embodiment of the present invention that is supplied with a film of material.

FIG. 2*a* is a spiral winder in accordance with the present invention. A film of material 100 is being supplied to the winder and rolled onto a spool 200. Also shown in FIG. 2*a* are an upper guide 800, lower guide 900, and a tilting guide 700 that direct and control the film of material as it is wrapped onto the spool.

FIG. 2*a* is representative of the situation presented when coiling material having a zipper attached along the length of the sheet that will later be used to form re-closable pouches. The area of the re-closable seal 300 is visible along one edge of the sheet of material 100. In addition to plastics that will later be used to form re-closable pouches, films of various other materials, such as metals and paper, and of varying widths and thicknesses, may be coiled onto spool or pin-like devices using spiral winders. Wrapping materials in this manner provides a convenient and effective means of containing, storing, and dispensing materials.

In the case of the sheet of material 100 in FIG. 2*a*, the thickness of the material in the area of the re-closable seal 300 is greater than the thickness of the remainder of the width 270 of the sheet 100. As the material 100 is coiled onto the spool 200, the winder accounts for the variation in film thickness by a continuous lateral oscillation of the spool 200 along its axis of rotation 240. The usable width of the spool 280 is necessarily wider than the film, and the linear oscillation along the axis 240 as the film 100 wraps onto the spool 200 resembles the action of a fishing reel. Without the oscillating action, because of the divergence in thickness along the width 270 of the sheet 100, as the material is coiled the radius of the coiled material at the end of the coil having the re-closable seal 310 builds up more quickly, and is ultimately greater than the radius of the rest of the coil. Such a divergence in the radius of the coil, from one end to the other, results in less material being wrapped per coil and instability of the coiled configuration itself. Such instability leads to telescoping and loss of valuable product and time.

On the other hand, employing the oscillating motion distributes the thicker re-closable seal area 310 across a greater width 280 of the spool 200, which ultimately lessons the divergence in the radius of the coil from one end to the other. This greater film distribution maximizes spool capacity and results in a coil of material that is wrapped more tensely and is more structurally stable for storage, and further handling and processing.

Figure 2B:
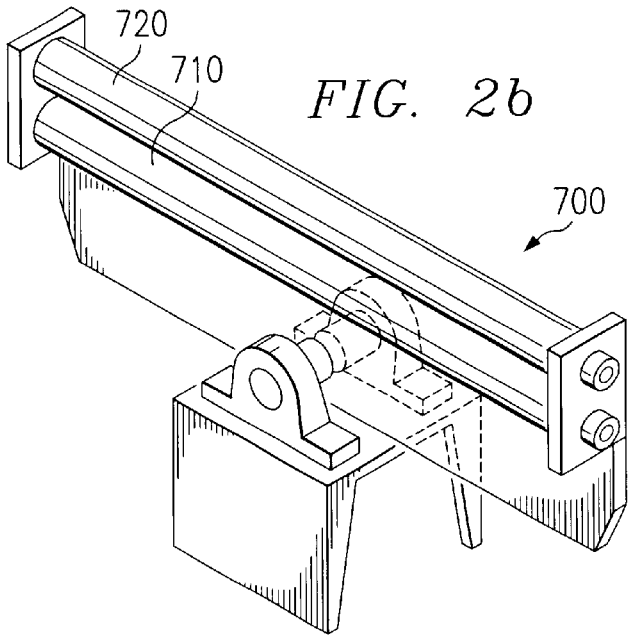
FIG. 2*b* is a perspective view of a tilting guide in accordance with the present invention.
Figure 2C:
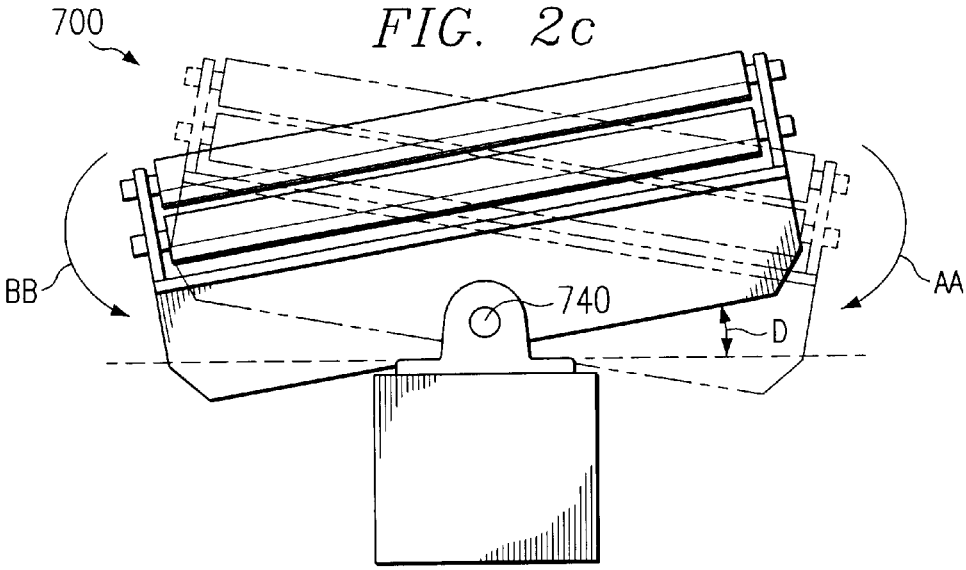
FIG. 2*c* is a perspective view of a tilting guide in accordance with the present invention that shows the tilting action of the guide.

The oscillating spool alone, however, does not optimize the process of coiling a film of varying thickness since, as noted previously, wrinkling can occur. The tilting guide 700, shown in FIGS. 2*a, b,* and *c*, is a key feature of the present invention used to eliminate the potential for wrinkling. FIG. 2*a* shows the position of the tilting guide 700 in one embodiment of the present invention. FIG. 2*b* is a perspective view of a tilting guide 700, including a lower roller 710 and upper roller 720. FIG. 2*c* demonstrates the tilting action of the guide 700. Other than the rotational movement of the lower roller 710 and upper roller 720 caused by the friction of the film 100 as the film 100 passes through the tilting guide 700, the only other movement of the guide 700 is a rocking motion about a single fixed point 740 where the guide 700 is attached to the spiral winder. The rocking motion occurs in the form of the guide tilting in one direction AA or the other BB.

As a spiral winder processes a film 100, the film 100 passes through the tilting guide 700 just prior to being wrapped onto the spool 200. The film 100 initially passes beneath the lower roller 710 of the tilting guide 700, then is threaded back between the lower roller 710 and upper roller 720, and is finally looped back over the upper roller 720 before being collected by the spool 200. The friction of the film 100 passing through the guide causes the rollers 710, 720 to rotate and allows the film 100 to pass through the guide more freely. As is more fully explained below, the amount and direction of the tension on the film 100 as it is coiled determine the degree D of the guide's 700 tilt. For example, when the spool 200 is at the center point of its oscillating range, the tension in the film 100, and the relative positions of the spool 200 and tilting guide 700, hold the tilting guide 700 in an upright position such that the degree D of the guide's 700 tilt is approximately zero.

As the spool 200 oscillates laterally in one direction A, the tensile force on the film 100 resulting from the rotation of the spool 200 as it collects the film 100, also changes in that direction A. As the direction A of the force on the film 100 changes, the tension along the width 270 of the film 100 becomes non-uniform. With spiral winders of the prior art, this non-uniform tension along the width of the film manifests itself in the form of slack along one edge of the sheet 100. As a result of the slack present along one edge of the film 100 as the film 100 is collected on the spool 200, for each layer within the resulting coil, the tightness of the film 100 varies across its width 270 and from layer to layer. Consequently, for any given region along the width 270 of the coiled material, the variation in tension and resulting slack in the region from layer to layer, may cause the material 100 in that region of a preceding layer of the coil where slack is present to be folded and wrinkled by a subsequent tighter layer.

With the present invention, however, as the spool 200 oscillates in one direction A, the resulting non-uniform tension in the film 100 causes the tilting guide 700 to lean in a compensating direction AA. The lean AA of the tilting guide 700 maintains a uniform tension along the entire width 270 of the film 100. By maintaining a uniform tension across the entire width 270 of the film 100 as the spool 200 oscillates, the tilting guide 700 averts layer-to-layer variations in tautness and resulting slack that would cause folds and wrinkles in the coiled layers of the film 100. Once the spool 200 completes its lateral movement in one direction A, it its oscillation in the other direction B. Just as with movement in one direction A, movement of the spool 200 in the other direction B causes the towing force on the film 100 to move in that direction B, and the tilting guide to lean in a compensating direction BB. In this way the compensating movements of the tilting guide 700 follow the back and forth movements of the spool 200 to keep any slack out of the film 100 as the spool 200 continuously rotates and oscillates to form a roll of film. Therefore, the present invention is able to successfully wrap a film 100 of non-uniform thickness onto a spool 200 and ultimately form a structurally stable roll with layers that are uniformly tight, wrinkle-free, and fit for further storage and processing.

Although one arrangement of a tilting guide 700 on a spiral winder, one roller configuration, and one method of threading a film 100 through a tilting guide 700 have been depicted, other tilting guide arrangements, roller configurations, and methods of threading may be employed to accomplish the goal of maintaining a uniform tension along the width 270 of a film 100 as it is coiled.

The necessary degree D of the guide's 700 tilt may vary depending on the span of the spool's 200 oscillation. In addition, the combination of the guide's 700 tilt and the span of the spool's 200 oscillation may necessarily be varied depending on any number of factors, such as the type and width 270 of the film 100, the extent to which the thickness of the film 100 varies along its width 270, the amount of tension on the film 100 as it is coiled, and the speed of rotation of the spool 200.

While the invention has been particularly shown and described with reference to a preferred embodiment, it will be understood by those skilled in the art that various changes in form and detail may be made therein without departing from the spirit and scope of the invention.

What is claimed is:

1. A method of guiding a film of material, having an uneven thickness across the width of the film, as it is collected into a coiled configuration, said method comprising the steps of:

feeding said film through a guide to a rotating collecting device while oscillating said collecting device along a line that parallels the direction of rotation said collecting device; and fixing said guide at a point such that said guide tilts about said point, wherein said tilt compensates for any changes in the direction of the tensile force on said film as it is coiled in order to ensure that said film is coiled smoothly, without wrinkling.

2. The method of claim 1 wherein said guide comprises at least one roller such that the friction of the film passing through the guide causes said at least one roller to rotate, thereby allowing thc film to pass through the guide with less frictional resistance.

3. The method of claim 1 wherein said guide comprises a first roller and a second roller arranged such that the friction of the film passing through the guide causes said first roller and said second roller to rotate, thereby allowing the film to pass through the guide with less frictional resistance.

4. The method of claim 1, further comprising the step of:

arranging said guide such that the direction and degree of said tilt is controlled by the amount and direction of the tensile force on said film as it is coiled.

5. The method of claim 4 wherein said guide comprises at least one roller such that thc friction of the film passing through the guide causes said at least one roller to rotate, thereby allowing the film to pass through the guide with less frictional resistance.

6. The method of claim 4 wherein said guide comprises a first roller and a second roller arranged such that the friction of the film passing through the guide causes said first roller and said second roller to rotate, thereby allowing the film to pass through the guide with less frictional resistance.

7. An apparatus comprising:

a rotatable collecting device for receiving a film of material that has an uneven thickness into a spirally wrapped configuration, wherein the usable width of said collecting device is greater than the width of the film; and a guide comprising a frame and a first roller rotatably mounted to said frame;

wherein said collecting device and said guide are mounted such that said guide directs the film to said collecting device, said collecting device is mounted to oscillate in a direction parallel to the axis of rotation of said collecting device, and said frame of said guide is attached at a fixed point about which said guide tilts.

8. The apparatus of claim 7, wherein said collecting device and said guide are connected to continuously oscillate.

9. The apparatus of claim 7, wherein said guide further comprises a second roller rotatably mounted to said frame such that the film of material passes between said first and said second rollers.

10. The apparatus of claim 7, wherein the direction and degree of said tilt is controlled by the direction of the tensile force on said film as said film is coiled.

11. A guide for directing a film of material onto a collecting device, said guide comprising:

a first roller attached to a frame, said frame being attached at a fixed point about which said guide tilts, said guide being connected to feed said film of material onto a spool that is oscillating in a direction lateral to a feed direction of said film.

12. The guide of claim 11, wherein changes in direction of the tensile force on said film as said spool moves cause said guide to tilt, ensuring that said film is coiled smoothly, without wrinkling.

13. The apparatus of claim 11, wherein said spool is connected to continuously move between two points.

14. The apparatus of claim 11, wherein said guide further comprises a second roller rotatably mounted to said frame such that the film of material passes between said first and said second rollers.

* * * * *